United States Patent [19]

Larsen

[11] Patent Number: 4,766,454

[45] Date of Patent: Aug. 23, 1988

[54] DEVELOPING TRAY

[75] Inventor: Rex S. Larsen, Rødovre, Denmark

[73] Assignee: Eskofot A/S, Ballerup, Denmark

[21] Appl. No.: 39,734

[22] Filed: Apr. 20, 1987

[30] Foreign Application Priority Data

Apr. 28, 1986 [DK] Denmark ..... 1941/86

[51] Int. Cl.[4] ..... G03D 3/08

[52] U.S. Cl. ..... 354/302; 354/299; 354/320; 354/338

[58] Field of Search ..... 354/301, 302, 305, 320, 354/321, 322, 338, 339, 318, 299

[56] References Cited

U.S. PATENT DOCUMENTS

| | | | |
|---|---|---|---|
| 3,236,168 | 2/1966 | Rautbord et al. | 354/301 |
| 3,694,071 | 9/1972 | Touchette | 354/318 |
| 3,875,581 | 4/1975 | Yamashita et al. | 354/318 |
| 4,464,035 | 8/1984 | Schoering | 354/322 |

FOREIGN PATENT DOCUMENTS

| | | | |
|---|---|---|---|
| 2164981 | 7/1973 | Fed. Rep. of Germany . | |
| 2623702 | 11/1979 | Fed. Rep. of Germany . | |
| 656444 | 10/1963 | Italy | 354/305 |

*Primary Examiner*—A. A. Mathews

*Attorney, Agent, or Firm*—Cushman, Darby & Cushman

[57] ABSTRACT

A developing tray for feeding a sheet of positive material and a sheet of negative material through a bath of developer. A lid is mounted above the bath for reducing the evaporation of developer. Feed rollers are provided both at the input opening and at the output opening. The bottom of the tray is provided with ribs extending substantially in the feeding direction of the sheets. A wetting roller at the output opening is actuated by the feed rollers and is partly immersed in the developer. The evaporation from the output rollers and the wetting roller thereby provides a cooling compensating for the heat produced by the motor during the developing process. In this way a substantially constant temperature is maintained in the bath without special temperature adjusting devices as the cooling is proportional to the period of operation of the motor.

4 Claims, 2 Drawing Sheets

DEVELOPING TRAY

FIELD OF THE INVENTION

The invention relates to a developing tray for feeding a sheet of positive material and a sheet of negative material through a bath of developer, above which bath a lid is mounted for minimizing the evaporation of developer, feed rollers being provided at the input opening and at the output opening, and whereby the bottom of the tray is provided with ribs extending substantially in the feed direction of the sheets.

In practice it has turned out to be difficult to maintain a substantially constant temperature in the developing tray as heat is produced during use of the developing tray.

SUMMARY OF THE INVENTION

The object of the invention is to indicate how the temperature can be kept constant and this object is according to the invention achieved by providing a wetting roller in connection with the rollers at the output opening, said wetting roller being rotated by the feed rollers and being partly immersed in developer.

In this way the wetting roller causes a certain evaporation from both the output rollers and the film and thereby provides a cooling proportional to the heat generated during the developing process. In this way a substantially constant temperature is achieved.

BRIEF DESCRIPTION OF THE DRAWING

The invention is more closely explained in the following with reference to the accompanying drawing, in which.

DESCRIPTION OF THE PREFERRED EMBODIMENTS

Figure 1:
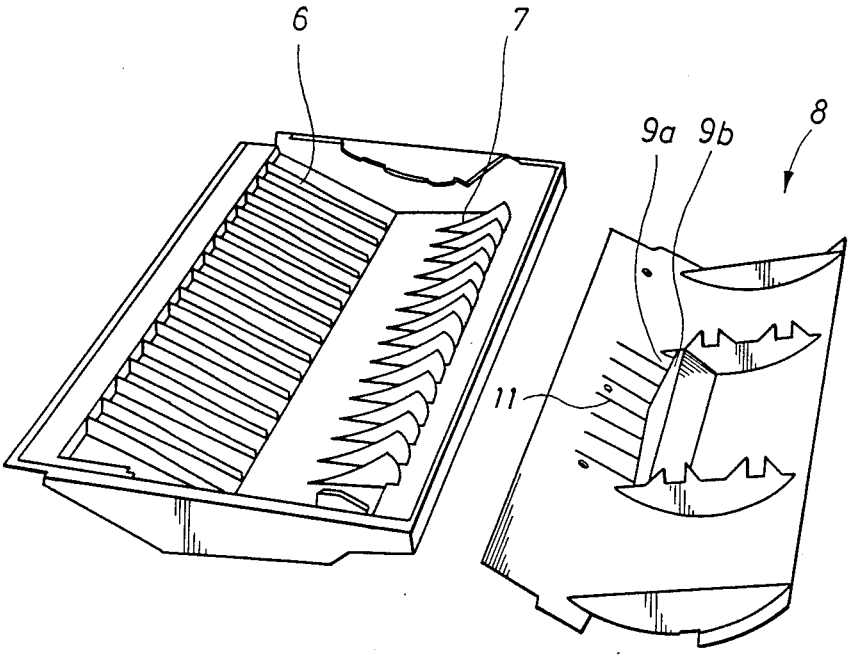
FIG. 1 illustrates a developing tray with an associated lid.

The developing tray shown in FIG. 1 allows feeding of a sheet of positive material and a sheet of negative material through a bath of developer. Over the bath a lid 8 is mounted which prevents an evaporation or an oxydation of the developer. Furthermore feed rollers 1, 2, 3, 4 are provided both at the input opening as well as at the output opening—cf. FIG. 2—, said rollers being motor-driven for achieving a uniform feeding speed through the developer. A plurality of ribs 6, 7 at the bottom of the tray ensure that the sheets with photographic material do not adhere to the bottom.

The length of the developing tray is primarily determined by the fact that a predetermined developing time is necessary. Furthermore the material in question must be fed through the bath at a predetermined speed in order to ensure a turbulence in the developer. The bath must therefore be of a certain minimum length. A problem is therefore caused by small sheets unable to reach the rollers at the output opening.

The same developing tray can, however, also be used in connection with light sensitive materials of a small size, e.g. A5-size and this is achieved by providing extra openings 9*a*, 9*b* in the lid 8, spaced from the rollers 3, 4 at the output opening in such a manner that the sheets of light sensitive material can just reach these rollers. Special control means can be provided in connection with these extra openings for ensuring a correct joining of the sheets.

Also in connection with the extra openings, ribs 11 may be provided for ensuring that the sheets do not adhere to the lid.

Figure 2:
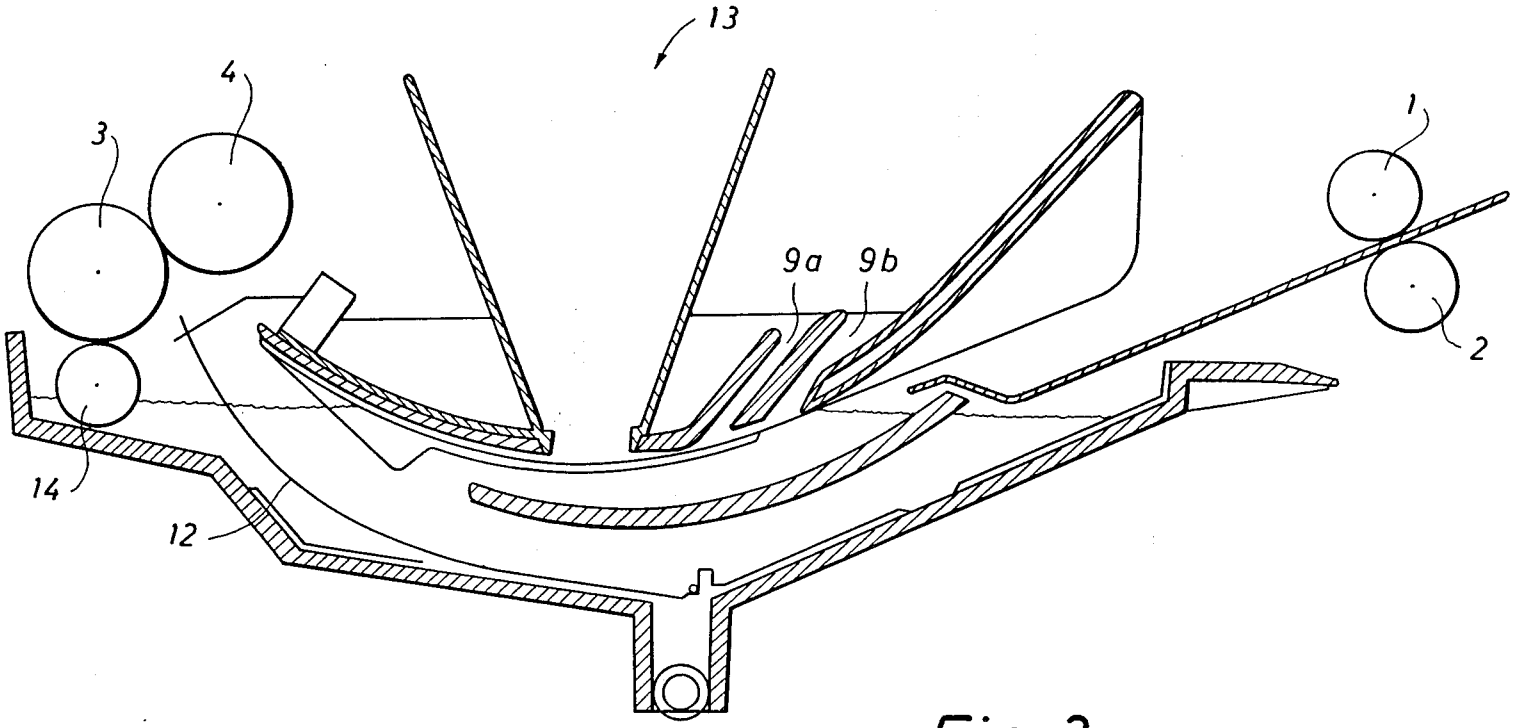
FIG. 2 is a sectional view through the developing tray with the lid mounted.

As shown in FIG. 2, the bottom of the tray may be provided with an extra bottom member 12 granulated on the surface and preferably made of stainless steel.

The diffusion process starts after the materials have been squeezed together by the output rollers 3, 4.

At the output opening, an additional roller 14 is optionally provided, said roller being actuated by the feed rollers 3, 4 and partly immersed in the developer and furthermore serving to wet the output rollers 3, 4. The evaporation from the output rollers and the wetting roller thereby provides a cooling compensating for the heat produced by the motor during the developing. In this way a substantially constant temperature is maintained in the bath without the use of special temperature adjusting devices as the cooling is proportional to the running period of the motor.

The developing tray is built into a box, a special lid being provided for the additional openings for other sizes.

The developing tray can be modified in many ways without thereby departing from the idea of the invention.

I claim:

1. A developing tray for feeding a sheet of positive material and a sheet of negative material through a bath of developer, above which bath a lid is mounted for minimizing the evaporation of developer, said tray and lid defining an input opening to the tray and an output opening from the tray, feed rollers at the input opening and at the output opening, the bottom of the tray being provided with ribs extending substantially in the feed direction of the sheets, a wetting roller situated at the output opening associated with the rollers at the output opening, said wetting roller being rotated by the feed rollers at the output opening and partly immersed in the developer.

2. A developing tray as claimed in claim 1, including a special cavity in the tray receiving the wetting roller.

3. A developing tray as claimed in claim 1, wherein the wetting roller is coated with rubber.

4. A developing tray as claimed in claim 1, wherein the wetting roller has a diameter of about 17 mm.

* * * * *